US005519371A

United States Patent [19]

Ogawa et al.

[11] Patent Number: 5,519,371

[45] Date of Patent: May 21, 1996

[54] DEFLECTION APPARATUS

[75] Inventors: Seiichi Ogawa; Tomohiro Kimura, both of Kanagawa, Japan

[73] Assignee: Sony Corporation, Tokyo, Japan

[21] Appl. No.: 357,760

[22] Filed: Dec. 16, 1994

[30] Foreign Application Priority Data

Dec. 22, 1993 [JP] Japan ..... 5-324859

[51] Int. Cl.[6] ..... H01J 29/70

[52] U.S. Cl. ..... 335/213; 313/440; 335/210

[58] Field of Search ..... 335/210–214; 313/440

[56] References Cited

U.S. PATENT DOCUMENTS

| | | | |
|---|---|---|---|
| 4,260,974 | 4/1981 | Nelle | 335/213 |
| 4,359,705 | 11/1982 | Bohn et al. | 335/213 |
| 4,547,709 | 10/1985 | French | 315/378 |
| 4,612,525 | 9/1986 | Sluyterman et al. | 335/213 |
| 4,786,838 | 11/1988 | Meershoek et al. | 313/440 |
| 5,077,533 | 12/1991 | Klingelhofer | 335/213 |
| 5,225,737 | 7/1993 | Sato | 313/440 |

FOREIGN PATENT DOCUMENTS

| | | |
|---|---|---|
| 0500251 | 8/1992 | European Pat. Off. . |
| 9320578 | 10/1993 | WIPO . |

*Primary Examiner*—Leo P. Picard
*Assistant Examiner*—Raymond M. Barrera
*Attorney, Agent, or Firm*—Jay H. Maioli

[57] ABSTRACT

The horizontal deflection apparatus has a separator whose cross-section takes a saddle-shape form, and horizontal deflecting coils are comprised of three coil groups connected in a series to each other. The first coil group is wound on the outermost circumference on the inside of the main structure of the separator, the second coil group is wound at a predetermined distance from the first coil group, and the third coil group is wound at a predetermined distance from the second coil group. Deflecting efficiency at the deflection center is improved because the deflection magnetic field generated from the second and third coil groups is generated at the deflection center.

12 Claims, 9 Drawing Sheets

DEFLECTION APPARATUS

BACKGROUND OF THE INVENTION

The present invention relates to a deflection apparatus that can be used with a horizontal deflection apparatus or a vertical deflection apparatus either of which uses groups of wound coils.

A cathode ray tube (CRT) for a computer monitor or a television set uses a horizontal deflection apparatus as a means for deflecting a picture into a horizontal position.

As illustrated in FIG. 1, the horizontal deflection apparatus has a saddle-shaped separator 10, inside of which groups of coils are wound separately into such saddle shape. Reference numeral 12 denotes the main structure of the separator which is made of resin and which has an upper bending portion 13 at its widest opening and a lower bending portion 14 at its narrowest opening. The horizontal deflecting coil groups 15 are wound separately around the upper bending portion 13 and the lower bending portion 14 in a predetermined area on the inside 12*a* (the side where the CRT is mounted) of the main structure of the separator 12, so as to be distributed in a predetermined manner.

FIG. 2 illustrates a typical example. The horizontal deflecting coil groups 15 are arranged in a position having a predetermined number of turns inside the main structure of the separator 12*a*, wound around hooks 16*a* to 16*f* of the upper bending portion 13 and partitions 17*a* to 17*c* in the middle of the main structure of the separator 12.

FIG. 3 is a schematic view illustrating the horizontal reflection apparatus 20 mounted on the CRT, which has an electron gun 22 in the neck 21*a* and the horizontal deflection apparatus 20 between the neck 21*a* and the funnel 21*b*. When receiving a sawtooth current, the horizontal deflection apparatus 20 scans and deflects an electron beam 23 horizontally onto a horizontal surface. Such deflecting apparatus is suggested in the U.S. patent application No. 832958 filed on Feb. 10, 1992 by this same applicant.

However, it is necessary to reduce the dissipation power because the screen of the CRT is enlarged and increases the horizontal deflection power. It is also necessary to reduce the horizontal deflection power in order to improve the picture quality and to reduce costs.

The horizontal deflection power PW is generally expressed in accordance with equation Eq.1.

$$PW=K\times D^2\times HV\times \mathrm{Sin}^2(0.5\times\theta)/l \qquad \text{(Eq1)}$$

where K is the proportional constant, D is the diameter of the neck, HV is the CRT high voltage. θ is the deflection angle (FIG. 3), and 1 is the magnetic path length of the horizontal deflection apparatus 20 (FIG. 3).

It is also known that the horizontal deflection power PW can be determined in accordance with equation Eq2.

$$PW=L\times I^2(mHA^2) \qquad \text{(Eq2)}$$

where L is the inductance of the horizontal deflecting coil groups 15, and I is the deflection current.

From Eq1, it is possible to solve the problem of reducing to greatest extent possible the horizontal deflection power PW, by (1) reducing the CRT high voltage HV. (2) reducing the diameter of the neck (the CRT 21 and the separator 10), (3) reducing the deflection angle θ, and/or (4) enlarging the magnetic path length l.

If the CRT high voltage HV is reduced, the luminance of the resulting picture is decreased because the speed at which the electron beam collides against the fluorescent screen 24 is decreased. If the diameter of the neck of the separator 10 and the CRT 21 is designed to be smaller, the diameter of the main electron lens in the electron gun 22 also becomes smaller, thereby causing the focus function and quality of the picture to deteriorate.

If the deflecting angle θ is reduced and the magnetic path length l is lengthened, the total length of the CRT 21 itself must also be lengthened and consequently the CRT becomes larger in size.

Thus, it is inappropriate to change the horizontal deflection power PW that is represented by the equation Eq1 because such change causes the picture quality to deteriorate and the CRT 21 to become longer.

SUMMARY OF THE INVENTION

In accordance with one aspect of the present invention, a deflection apparatus is comprised of a separator, whose the cross-sectional perspective is formed into shape of a saddle, a first coil group wound on the outermost circumference inside said separator, and a second coil group wound inside said first coil group and arranged at a predetermined distance from said first coil group.

The deflecting coil groups 15 are comprised of a first coil group 15*a* and a second coil group 15*b*. The first coil group 15*a* is wound separately on the outermost circumference inside the main structure of the separator 12, while the second coil group 15*b* is wound on the inside of and at a predetermined distance from the first coil group 15*a*. As shown in FIG. 11, the curved line La, representing the prior art, corresponds to the magnetic field strength at the center of the deflection of the electron beam and in the present invention it is increased to the level represented by the curved line Lb.

Such increase of the deflecting magnetic field improves the horizontal deflecting efficiency without changing the other elements of the equation Eq1.

This makes it possible to improve the picture quality and diminish the size by reducing the horizontal deflection power, while maintaining the quality of the picture from the prior art.

The concluding portion of this specification particularly points out and distinctly claims the subject matter of the present invention. However, those skilled in the art will best understand both the organization and method of operation of the invention, together with further advantages and objects thereof, by reading the following description with reference to the accompanying drawings wherein like reference characters refer to like elements.

DETAILED DESCRIPTION OF THE PREFERRED EMBODIMENT

A preferred embodiment of the present invention will now be described with reference to the accompanying drawings.

Figure 1:
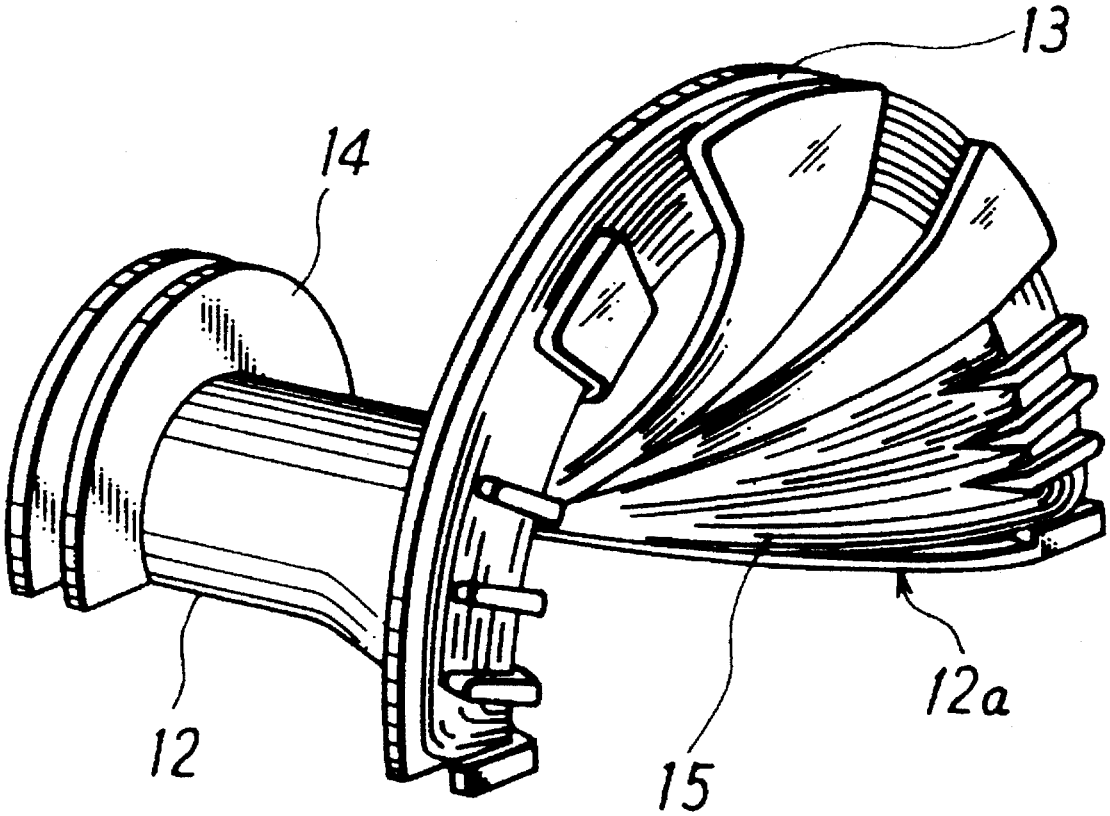
FIG. 1 is a perspective illustration of a separator.
Figure 2:
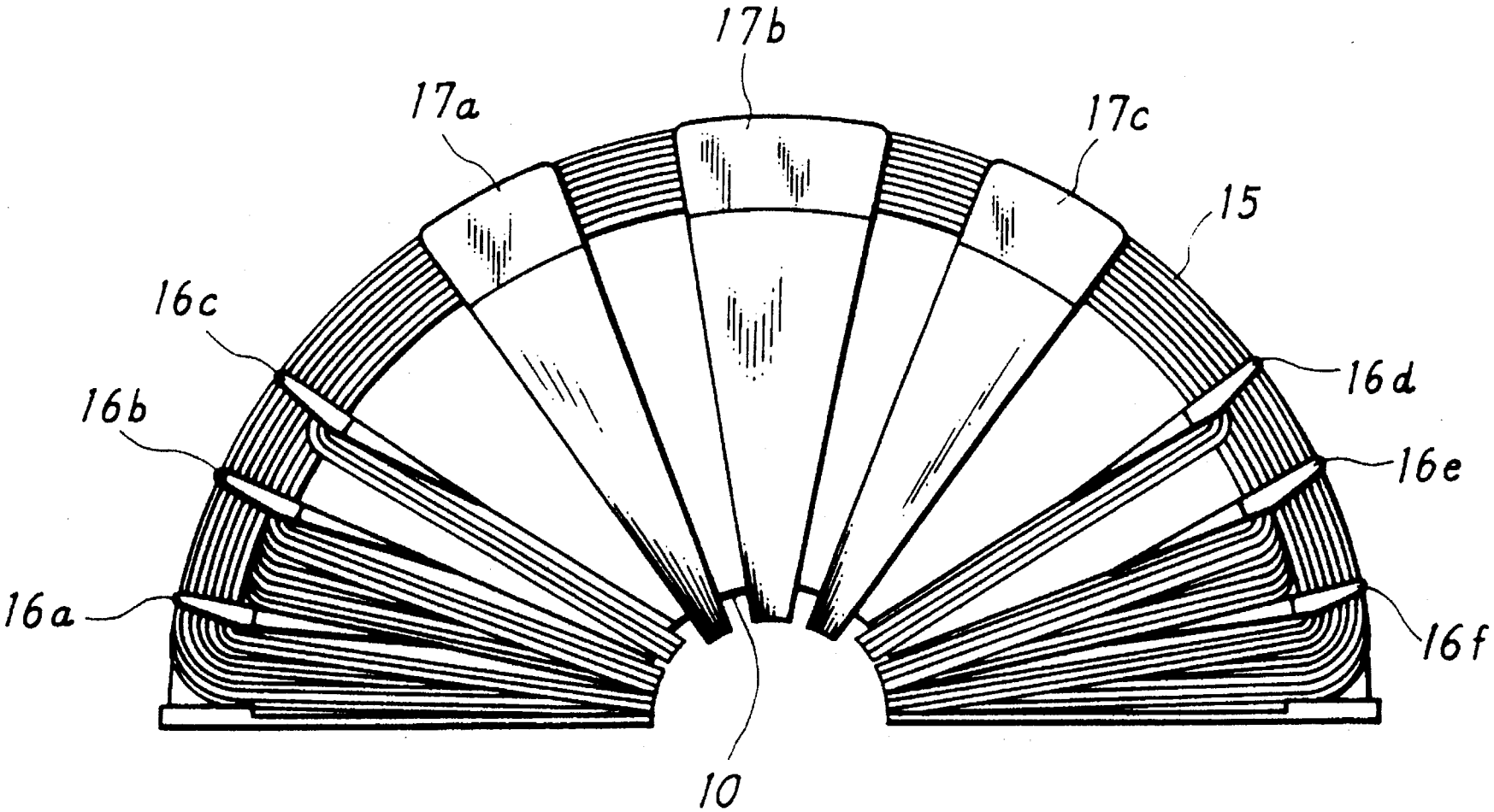
FIG. 2 is a frontal view (diagram) of a horizontal deflection apparatus currently in use.
Figure 3:
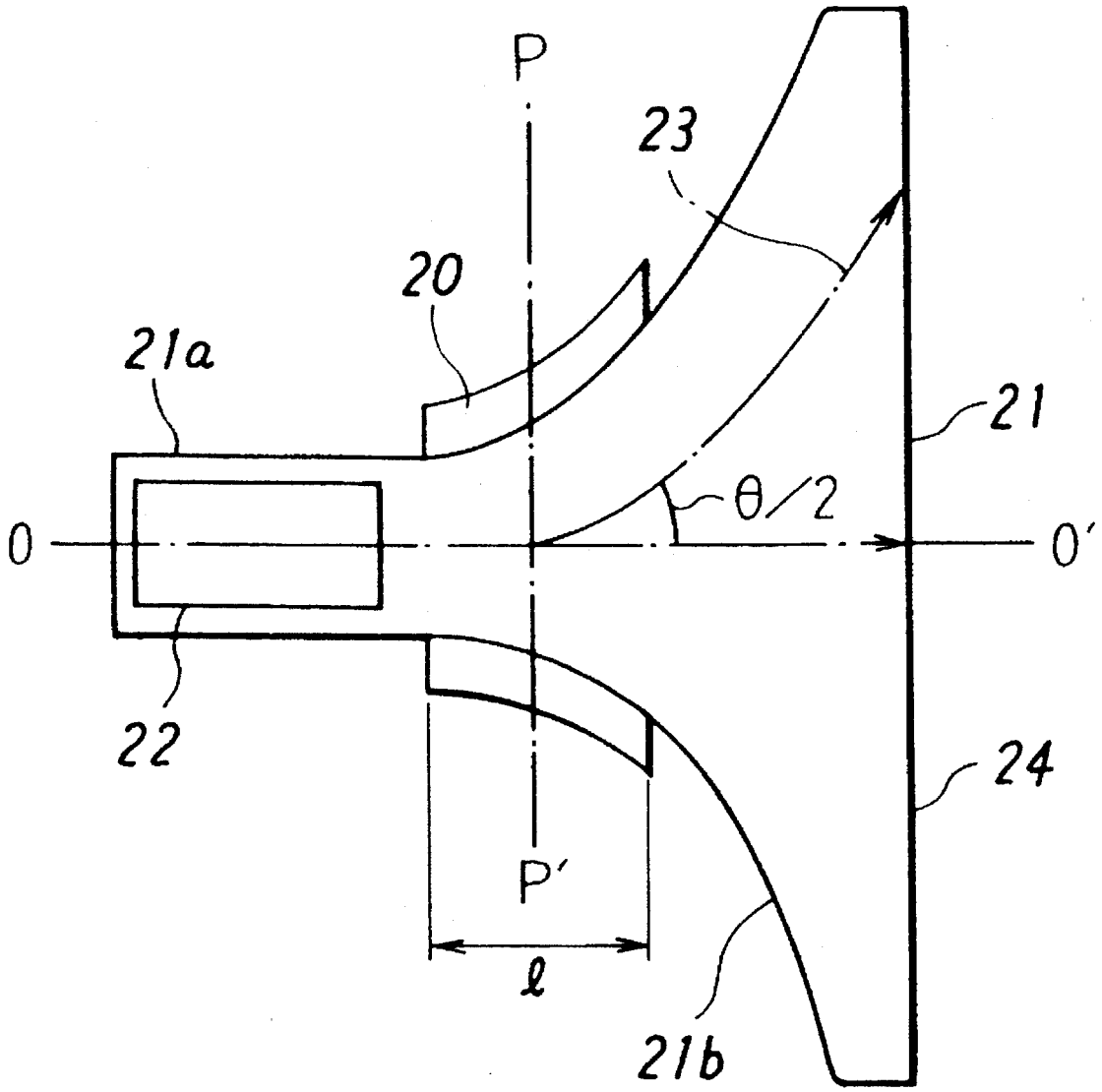
FIG. 3 is a cross-sectional view of a CRT currently in use.
Figure 4:
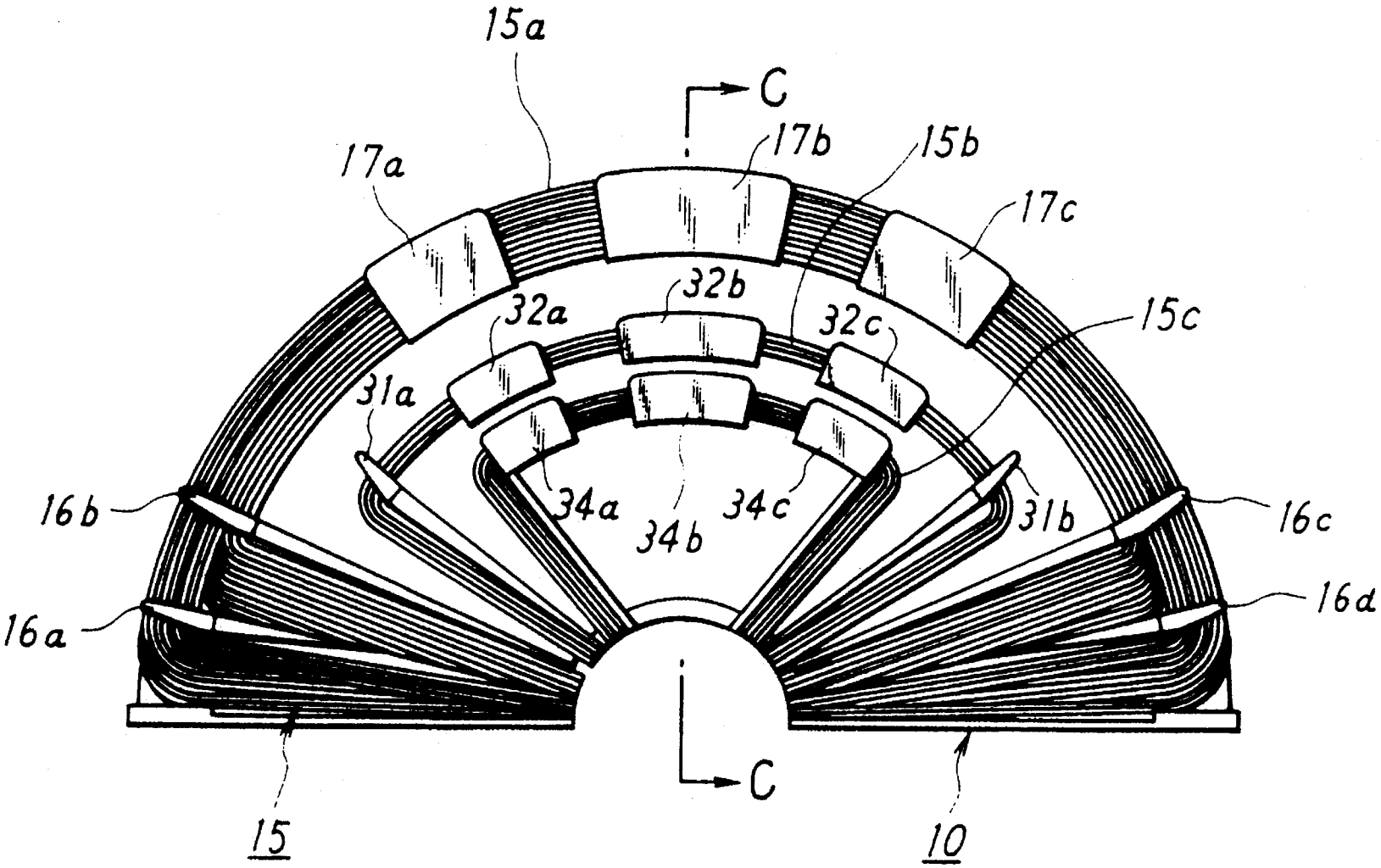
FIG. 4 is an frontal view (diagram) of one embodiment of a horizontal deflection apparatus according to the present invention.

FIG. 4 illustrates the view from one side of the horizontal deflection apparatus 20 showing the inner side closest to the CRT as one embodiment according to the present invention.

Horizontal deflecting coil groups 15 are divided into a plurality of coil groups. Of the horizontal deflecting coil groups 15 which are wound on the inside 12*a* of the main structure of the separator 12, the coil group which is wound around the outermost circumference is termed the first coil group 15*a*, which is in the same position as in the horizontal deflecting coil groups of the prior art. However, the number of times the coil is wound around the circumference is less than in the prior art.

The second coil group 15*b* is wound on the inside of and at a predetermined distance from the first coil group 15*a*.

Figure 5:
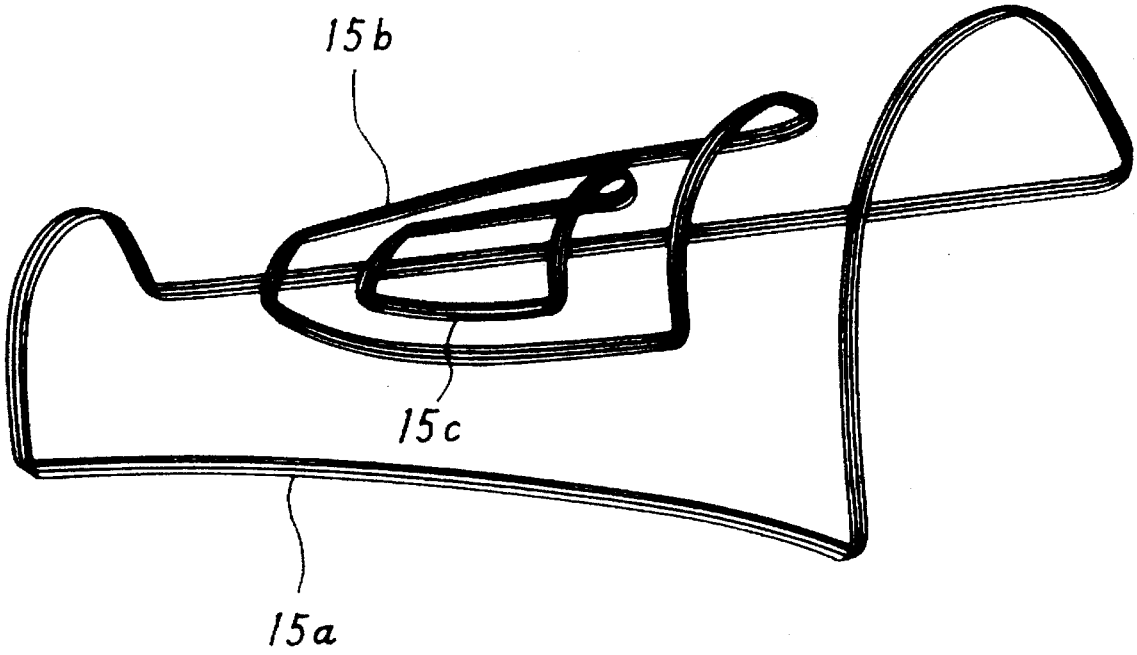
FIG. 5 is a perspective illustration of the relative positions of the first to third coil groups.

The third coil group 15*c* is wound on the inside of and at a predetermined distance from the second coil group 15*b*. FIG. 5 illustrates the relative positions of the coil groups 15*a* to 15*c* so as to be easily understood by isolating the coil groups and emphasizing the distances between them.

The number of loops for the second coil group 15*b* and the third coil group 15*c* are set to be 1/1 to 1/10 or more times the number of loops for the first coil group 15*a*, depending on the relationship between the space for winding and the deflecting magnetic field.

In order to arrange in position the first to third coil groups 15*a* to 15*c*, the main structure of the separator 12 has hooks and partitions for arrangement as shown in FIG. 4.

Figure 6:
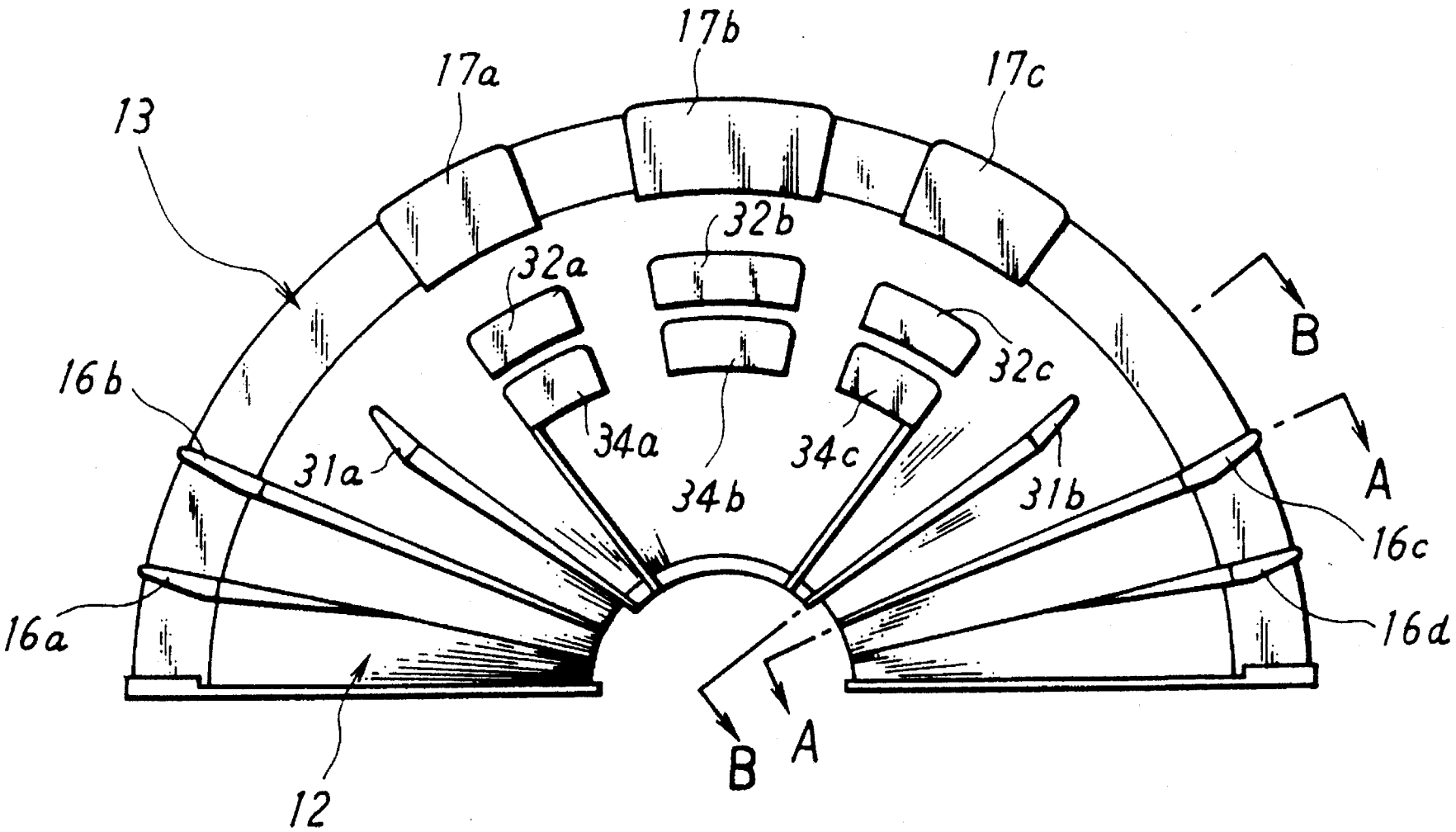
FIG. 6 is an frontal view of an example of a separator used in FIG, 4.

Referring to FIG. 4 and FIG. 6, the four hooks 16*a* to 16*d* are formed in positions such that each pair of hooks 16*a* and 16*b*, and 16*c* and 16*d*, are arranged respectively on the right and left sides at predetermined intervals and the three partitions 17*a* to 17*c* are formed in the middle of the outermost circumference, so as to arrange the first coil group 15*a* on the outermost circumference of the main structure of the separator 12.

Figure 7:
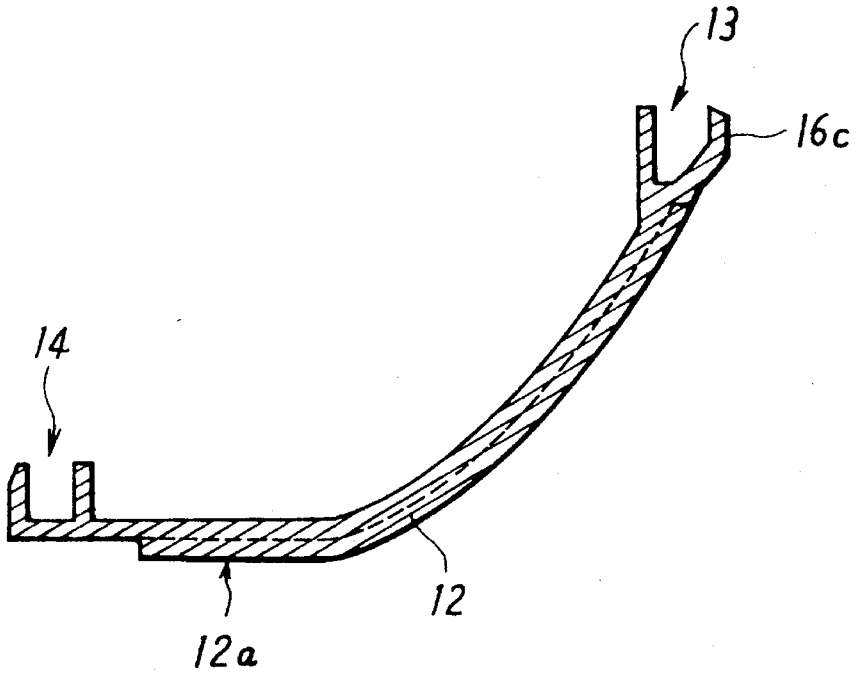
FIG. 7 is a cross-sectional view of line A—A from FIG. 6.

The hooks 16*a* to 16*d* are formed into the shapes illustrated in FIG. 7, and their width corresponds to the number of turns necessary for the coil. The long portions of the hooks separate the coil from the neighboring coils.

Figure 8:
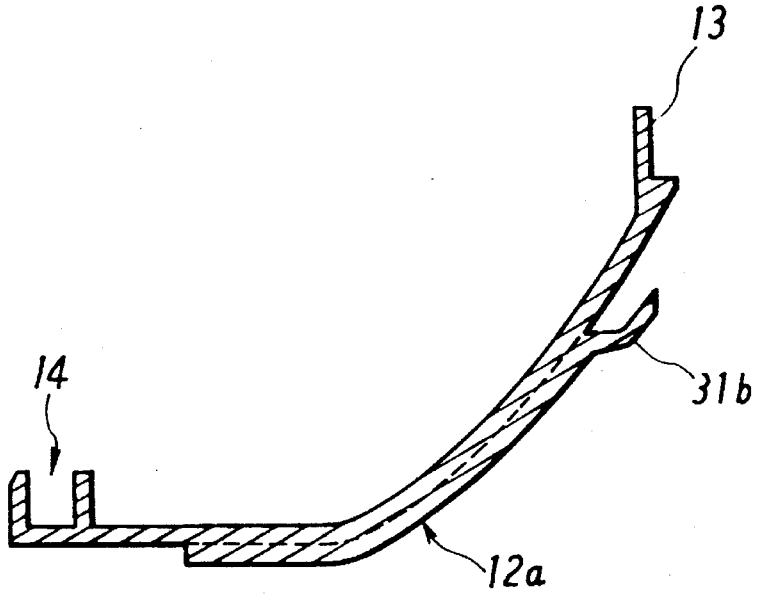
FIG. 8 is a cross-sectional view of line B—B from FIG, 6.

The first coil group 15*a* is wound around the hooks 16*a* to 16*d* and the partitions 17*a* to 17*c* in saddle-shape form. As illustrated in FIG. 4 and 6, two hooks 31*a* and 31*b* are formed in the middle inside the main structure of the separator 12*a* where one hook is arranged on the right side, one hook is on the left side and three partitions 32*a* to 32*c* are formed between the hooks 31*a* and 31*b*. The second coil group 15*b* is wound around such hooks in a predetermined position. FIG. 8 is a cross-sectional view of the hook 31*b*.

Figure 9:
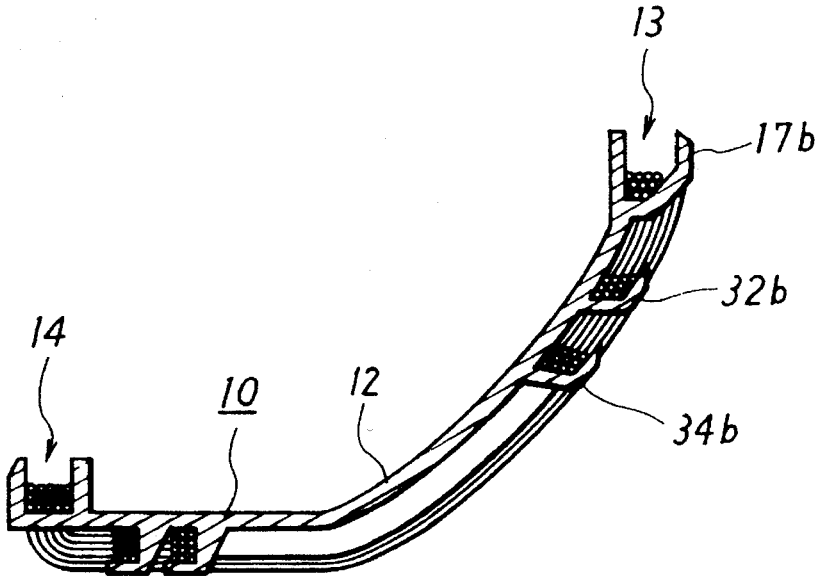
FIG. 9 is a cross-sectional view of line C—C from FIG, 4.

Three partitions 34*a* to 34*c* are formed for the third coil group 15*c*. Referring to FIG. 9, each of the partitions, 34*a* to 34*c*, is separated by small intervals in order not to interfere with the winding of the coils.

If necessary, a third coil group 15*c* may be used. When such a third coil group 15*c* is not used, the second coil group 15*b* is arranged in such a position so as to distribute properly the magnetic field as described below.

The horizontal deflecting coil groups 15 (the upper horizontal deflecting coil groups) are comprised of the first, second and third coil groups 15*a* to 15*c*, which are connected in a series to each other, in such a way that the main structure of the separator 12 holds the second and third coil groups 15*b* and 15*c* inside at the middle. The horizontal deflection apparatus is comprised of the upper horizontal deflecting coil groups 15 and a lower horizontal deflecting coil groups (not shown) which have the same structure as the upper horizontal deflecting coil groups.

Figure 10:
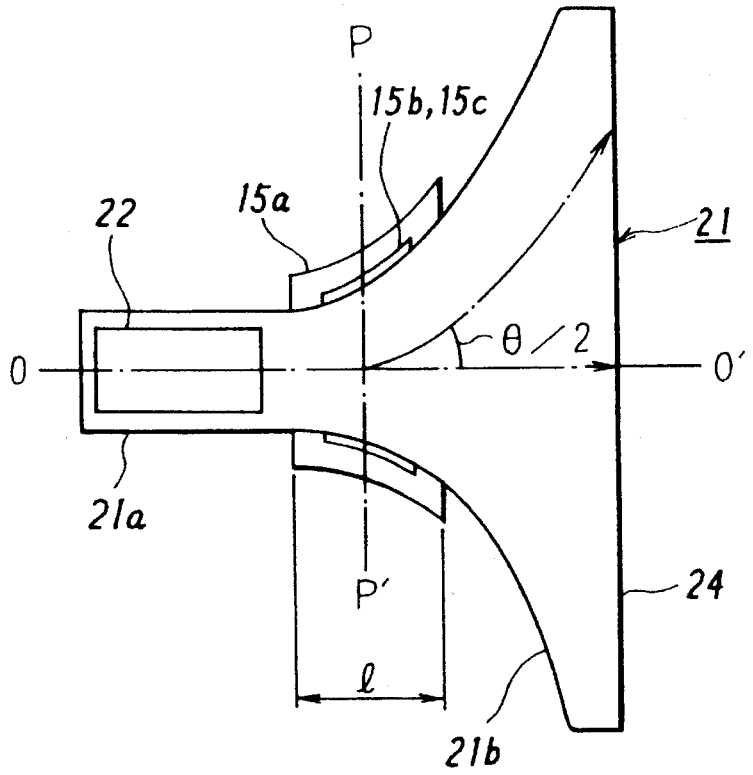
FIG. 10 is a cross-sectional view of a CRT using the horizontal deflection apparatus according to the present invention.
Figure 11:
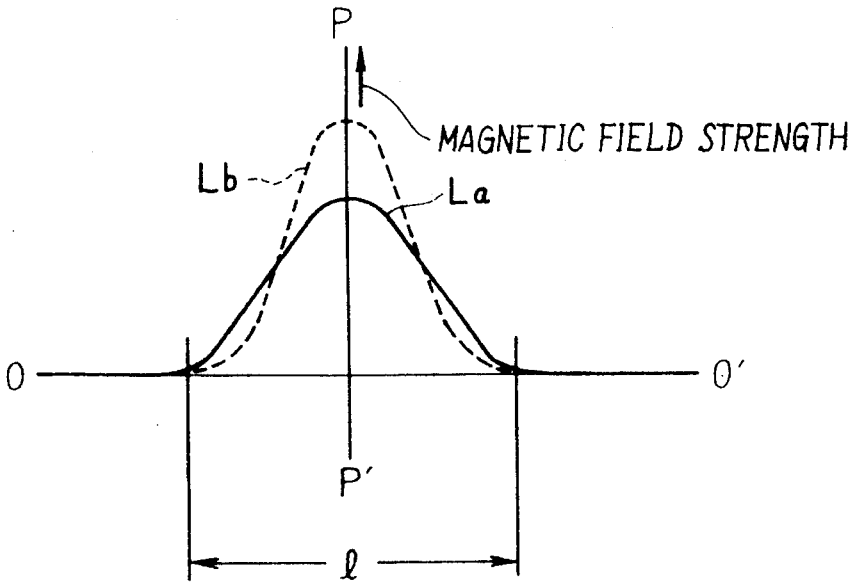
FIG. 11 illustrates the distribution of the magnetic field in connection with FIG. 10.

FIG. 10 illustrates the above, and FIG. 11 illustrates the distribution of the magnetic field on the deflection center line P—P' from FIG. 10. The curved line La corresponds to the distribution of the magnetic field of the horizontal deflection apparatus of the prior art without the second and third coil groups, and the curved line Lb corresponds to the distribution of the magnetic field in the horizontal deflection apparatus according to the present invention.

As clearly seen from the comparison of two curved lines La and Lb, the magnetic field strength is larger at the deflection center of the electron beam of the curved line Lb. The second and third coil groups 15*b* and 15*c* which are arranged at the deflection center contribute to the efficient generation of the magnetic field.

The horizontal deflection power I can be increased with the deflecting current set at the same level as in the prior art. That is to say, the deflecting current I can be reduced, while generating the same level of the horizontal deflection power.

Figure 12:
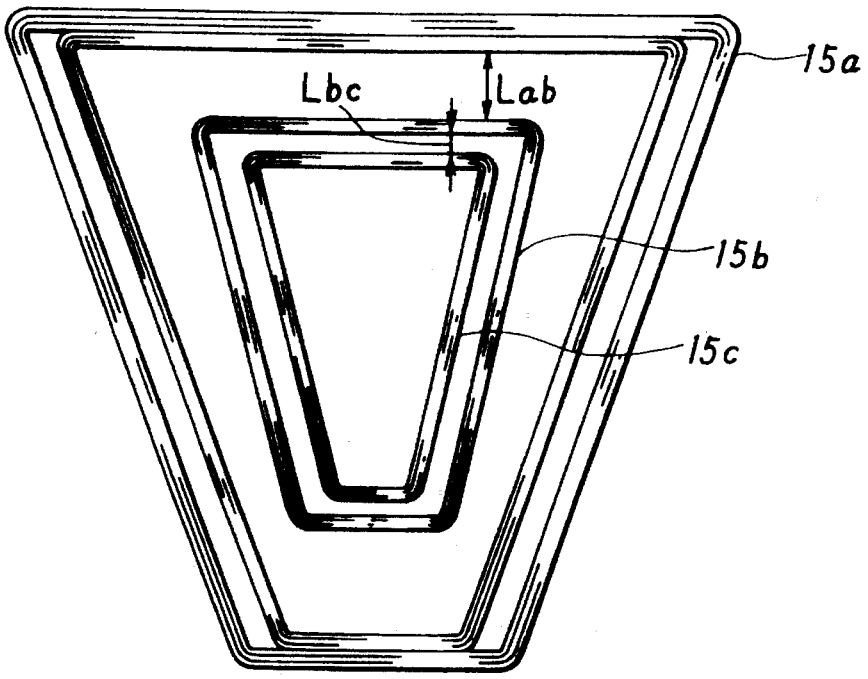
FIG. 12 illustrates the positions of the first to third coil groups.

Referring to FIG. 12, a concrete example is given as follows:

first coil group: 55 turns second coil group: 6 turns third coil group: 9 turns inductance of horizontal deflecting coil L: 602.9 mH distance between first and second coil group Lab: 1 mm distance between second and third coil group Lbc: 1 mm The total number of turns for the horizontal deflecting coil groups 15 is the same as in the prior art. When such horizontal deflection apparatus (DY) 20 is mounted in the CRT (28 inches), the horizontal deflection power PW is as follows:

| | DY in Prior Art | DY in The Invention |
|---|---|---|
| Deflection Current I | 8.61 A | 8.59 A |
| Deflection Power | 49.1 mHA$^2$ | 44.5 mHA$^2$ |

As described above, the present invention can save 9.4% of the horizontal deflection power PW, as compared to the prior art.

There could be many other examples of different numbers of coil groups, numbers of coils turns, and distances between the coil groups. It is also feasible to combine the first and second coil groups 15*a* and 15*b* or to combine the first and third coil groups 15*a* and 15*c*. When such deflection apparatus is used in a large CRT, it is more effective to arrange fourth and fifth coil groups inside the third coil group 15*c*.

Although, in the embodiment, the present invention is applied to a horizontal deflection apparatus, it is feasible to apply the invention to a vertical deflection apparatus, which is also in a saddle-shape form.

As described above, in the present invention, the deflecting coil groups must separate the second coil group from the first coil group on the outermost circumference of the separator.

It is accordingly possible to distribute properly the magnetic field because the deflecting magnetic field at the deflection center of the electron beam is concentrated. This invention prevents the picture quality from deteriorating because the deflection efficiency can be improved without reducing the CRT high voltage and without reducing the diameter of the CRT neck. In this case, the CRT does not become larger because the deflection angle θ and the magnetic path length l are the same as in the prior art.

This invention is accordingly suitable for a CRT in a television set where it is necessary to reduce dissipation power.

What is claimed is:

1. A deflection apparatus for deflecting an electron beam in a cathode ray tube comprising:

a separator whose cross-section takes a saddle-shape form for arranging coil groups on the cathode ray tube;

a first coil group having a first plurality of turns wound on an outermost circumference of said separator and being arranged on an inner surface thereof for generating a first deflection magnetic field; and a second coil group having a second plurality of turns wound entirely within said first coil group and arranged at a predetermined distance from said first coil group for generating a second deflection magnetic field substantially at a center of deflection of the electron beam.

2. The deflection apparatus according to claim 1, further comprising positioning means for arranging said first and second coil groups in position on said separator.

3. The deflection apparatus according to claim 2, wherein said positioning means is a hook or a partition.

4. The deflection apparatus according to claim 1, further comprising a third coil group having a third plurality of turns wound apart from and entirely within said second coil group for generating a third deflection magnetic field substantially at the center of deflection of the electron beam.

5. The deflection apparatus according to claim 1, wherein said first and second coil groups are connected in series.

6. The deflection apparatus according to claim 1, wherein said first and second coil groups are one of horizontal deflecting coil groups and vertical deflecting coil groups.

7. The deflection apparatus according to claim 1, wherein said first plurality of turns of said first coil group is greater than said second plurality of turns of said second coil group.

8. The deflection apparatus according to claim 4, wherein said first plurality of turns of said first coil group is greater than said second plurality of turns of said second coil group and said third plurality of turns of said third coil group is greater than said second plurality of turns of said second coil group.

9. The deflection apparatus according to claim 8, wherein said first plurality of turns of said first coil group is 55, said second plurality of turns of said second coil group is 6, and said third plurality of turns of said third coil group is 9.

10. The deflection apparatus according to claim 4, wherein the predetermined distance from said first coil group to said second coil group is the same as a distance from said second coil group to said third coil group.

11. The deflection apparatus according to claim 10, wherein the distance between said first coil group and said second coil group and the distance between said second coil group and said third coil group are both equal to 1 millimeter.

12. The deflection apparatus according to claim 11, wherein said first plurality of turns of said first coil group is 55, said second plurality of turns of said second coil group is 6, and said third plurality of turns of said third coil group is 9.

* * * * *